US010167709B2

(12) United States Patent
Kasevich et al.

(10) Patent No.: US 10,167,709 B2
(45) Date of Patent: Jan. 1, 2019

(54) SUBSURFACE MULTIPLE ANTENNA RADIATION TECHNOLOGY (SMART)

(71) Applicant: TURBOSHALE, INC., Midvale, UT (US)

(72) Inventors: Raymond Kasevich, Mount Washington, MA (US); Jeb Rong, Mount Washington, MA (US)

(73) Assignee: TurboShale, Inc., Midvale, UT (US)

( * ) Notice: Subject to any disclaimer, the term of this patent is extended or adjusted under 35 U.S.C. 154(b) by 0 days.

(21) Appl. No.: 14/734,150

(22) Filed: Jun. 9, 2015

(65) Prior Publication Data

US 2015/0354333 A1 Dec. 10, 2015

Related U.S. Application Data

(60) Provisional application No. 62/017,408, filed on Jun. 26, 2014, provisional application No. 62/009,482, filed on Jun. 9, 2014.

(51) Int. Cl.

| | |
|---|---|
| ***E21B 43/24*** | (2006.01) |
| ***E21B 47/09*** | (2012.01) |
| ***H05B 6/72*** | (2006.01) |

(52) U.S. Cl.

CPC ..... *E21B 43/24* (2013.01); *E21B 47/09* (2013.01)

(58) Field of Classification Search

CPC .... E21B 43/2401; E21B 36/04; E21B 43/305; E21B 43/2408; E21B 43/295; E21B 47/12; E21B 43/24; E21B 47/09; E21B 43/243; E21B 47/082; E21B 47/10; E21B 47/122; H05B 6/72; H05B 3/0004; G01S 13/4409; G01S 13/4463; G01S 2013/0245; G01S 13/42; G01V 3/30

See application file for complete search history.

(56) References Cited

U.S. PATENT DOCUMENTS

| | | | | |
|---|---|---|---|---|
| 3,346,861 | A | 10/1967 | Chadwick et al. | |
| 3,594,811 | A | 7/1971 | Pierrot | |
| 5,065,819 | A | 11/1991 | Kasevish | |
| 5,199,488 | A | 4/1993 | Kasevich et al. | |
| 6,189,611 | B1 | 2/2001 | Kasevich | |
| 6,413,399 | B1 | 7/2002 | Kasevich | |
| 7,203,469 | B2 | 4/2007 | Yamaguchi et al. | |
| 7,891,421 | B2 | 2/2011 | Kasevich | |
| 2002/0044078 | A1* | 4/2002 | Liedtke | B25F 5/00 342/22 |

(Continued)

OTHER PUBLICATIONS

Gregoire et al. "Use of Borehole Radar Measurements to Monitor a Steam-Enhanced Remediation Pilot Study" Scientific Investigations Report 2006-5191, USGS 2002 teaches borehole radar to measure the flow of fluid in a fracture.*

(Continued)

*Primary Examiner* — William D Hutton, Jr.
*Assistant Examiner* — Charles R Nold
(74) *Attorney, Agent, or Firm* — Snell & Wilmer L.L.P.

(57) ABSTRACT

An in-situ radar guidance system with a collocated high power electromagnetic heating system or SMART System (Subsurface Multiple Antenna Radiation Technology) creates chemical, physical, and electrical changes as needed to certain organic or inorganic materials for energy efficient recovery of liquids, gases, and solids.

18 Claims, 5 Drawing Sheets

(56) References Cited

U.S. PATENT DOCUMENTS

| | | | | |
|---|---|---|---|---|
| 2003/0089494 | A1* | 5/2003 | Van Oers | G01V 3/30 166/250.16 |
| 2003/0102995 | A1* | 6/2003 | Stolarczyk | F41H 11/12 342/22 |
| 2012/0118879 | A1* | 5/2012 | Rey-Bethbeder | E21B 43/2401 219/679 |
| 2014/0041862 | A1* | 2/2014 | Ersoz | G01V 3/30 166/250.1 |
| 2015/0123835 | A1* | 5/2015 | Sokolowsky | G01V 3/38 342/22 |
| 2017/0268319 | A1* | 9/2017 | Hyde | E21B 47/102 |

OTHER PUBLICATIONS

M. Sato, T. Takayama, "High range resolution directional borehole radar for 3D fracture delineation", Proc. IEEE Int. Geoscience and Remote Sensing Symp., pp. 132-135, 2009, teaches high resolution borehole radar using arrays.*

Hofinghoff, Jan-Florian (2013). "Resistive Loaded Antenna for Ground Penetrating Radar Inside a Bottom Hole Assembly". IEEE Transactions on Antennas and Propagation. IEEE. 61 (12) teaches borehole radar.*

Miorali "Borehole radar for oil production monitoring" Thesis, Master of Science in Geology, Jan. 25, 2012.*

Bridges et al., "Radio-Frequency Heating to Recover Oil From Utah Tar Sands," 1979, IIT Research Institute, pp. 396-409.

Gill, "The Electrothermic System for Enhancing Oil Recovery," Journal of Microwave Power, 18(1), 1983.

* cited by examiner

SUBSURFACE MULTIPLE ANTENNA RADIATION TECHNOLOGY (SMART)

CROSS REFERENCE TO RELATED APPLICATIONS

This application claims priority to U.S. Provisional Application No. 62/009,482, filed on Jun. 9, 2014 and U.S. Provisional Application No. 62/017,408, filed on Jun. 26, 2014, the contents of which are hereby incorporated by reference in their entirety.

BACKGROUND

A combination of measurement and control techniques is being increasingly used in the oil industry to capture fluid dynamics in the far-field (several meters) of well bores as it has the potential to significantly improve oil and gas production. This is due to the recent development of oil well technology which allows zonal production control and monitoring in real time through respectively, inflow control valves and down hole sensors. Inflow control valves are capable of imposing a pressure profile along the well that can influence the flow behavior. The advantage of this type of proactive control is that potential problems such as the approach of unwanted fluids or migration of wanted fluids toward production wells can be mitigated before they impact production. The efficiency of these strategies is based on the capacity of measuring or predicting changes in the reservoir away from the well bore.

The presence of an enormous volume of potentially recoverable gas in shale rock in the United States (e.g., Marcellus shale gas) has a great economic significance. This will be some of the closest natural gas to the high population areas of New Jersey, New York and New England. This transportation advantage will give Marcellus shale gas a distinct advantage in the marketplace. Natural gas occurs within Shale rock in three ways: 1) within the pore spaces of the shale; 2) within vertical fractures (joints) that break through the shale; and 3) adsorbed on mineral grains and organic material. Most of the recoverable gas is contained in the pore spaces. However, the gas has difficulty escaping through the pore spaces because they are too small, poorly connected, or non-existent to provide gas recovery pathways Removal or desorption of natural gas in rock formations using radiofrequency energy occurs by two basic mechanisms: (1) the molecular vibration of gas molecules attached to shale surfaces interacting with the radiofrequency electric fields and (2) the expansion of and increased interconnected micro cracks of rock by heating connate water or fossil water to create enhanced rock permeability for gas recovery. Localized expansion of pore water in rock to create micro fracturing is based on the radiofrequency heating of pore water to create high vapor pressures. No injected water or chemicals is required.

Detailed information on fracture network architecture greatly assists in the recovery of gas and oil in rock or other tight formations through location of existing pathways for gas flow or oil vapor recovery. Positioning of RF high power antennas in the vicinity of fractures allows for increased gas flow derived from desorption or chemical pyrolysis using electromagnetic energy of appropriate frequency and intensity as well as providing fracture network enhancement through RF heating through steam generation. No water injection or chemical injections are required.

Removal of many pollutants or toxic material is especially difficult when the contaminants enter bedrock fractures. For example, The heterogeneous distribution of residual 1,1,1-trichloroethane (TCA) dense nonaqueous phase liquid (DNAPL) within discrete, poorly connected bedrock fractures renders many remedial technologies inefficient or ineffective because the DNAPL cannot be physically removed or reached to treat in situ. Thermal resistivity heating and thermal conduction heating can treat a targeted volume of bedrock, overcoming the physical constraints of the bedrock fracture network, but can be prohibitively expensive to implement due to energy requirements for heating the rock mass. Thus, a system and method that facilitates the removal of such pollutants from bedrock fractures would be beneficial.

SUMMARY OF INVENTION

This invention describes a three-dimensional wellbore antenna array radar for detection and surveillance purposes with a collocated high power radiofrequency antenna for the chemical and physical treatment and efficient recovery of organic and inorganic materials in subsurface or surface formations such as hydrocarbons or toxic chemicals. The radar is initially used for physically guiding or directing the application of high power electromagnetic radiation in borehole to the appropriate target material. The high power radiation antenna provides heat and physical or chemical alterations of the material during treatment and processing such as desorption of gas from rock fractures through weakening of chemical bonds, microfracking through increased pore connate water expansion as liquid or vapor or thermal pyrolysis of organic material such as kerogen in oil shale to produce various gases and heavy oil.

The present invention relates generally to the collocation and simultaneous operation of radar surveillance systems with high power electromagnetic radiation structures such as antennas or other electromagnetic systems such as resonant transmission lines for controlled and directive energy delivery to subsurface organic and inorganic materials for recovery. As hot oil mass drains downward to a production well, a receiving antenna is constantly identifying the movement of the hot oil mass through absorption and scattering of the transmitting signal back toward the receiving antenna. The mass of the heated oil and location is continuously monitored by the antenna.

The collocated high power radiation system in the radiofrequency range provides physical or chemical alterations of the material during thermal treatment and processing such as desorption of gas from rock, coal seams as in coal bed methane deposits, or shales as in oil shale through weakening of chemical bonds or chemical pyrolysis of organic material such as kerogen to produce recoverable gases. The thermal and non-thermal energy from the high power antenna may lower liquid viscosity, improve mobility, cause desorption of gases from rock interfaces, enhance or create fracture, and alter molecular structure of the organic and inorganic material for more energy efficient recovery. Alteration of the chemical and rheological properties of hydrocarbons (heavy oil) using radiofrequency also improves recovery of hydrocarbons (heavy oil) through reduction in oil viscosity, enhanced rock permeability, and weakening of chemical bonding properties.

A super gain array antenna design (U.S. Pat. No. 7,203,469) modified for subterranean application is proposed for one possible radar system design to greatly improve the ability of the radar to provide significant accuracy of locating small voids and fractures in the rock formation to assist in production control of the fluids and gases mobilized by the radiofrequency energy.

Much higher resolution may be achievable by employing super gain antenna principles as proposed here. The much higher borehole antenna gain achievable allows for the use of a lower frequency for greater depth of penetration without sacrificing resolution. In earth media where attenuation of signal plays such an important role in discerning targets at a few tens of meters is practically significant for efficient oil and gas recovery The present invention imparts heat to the targeted area through the application of carefully controlled (e.g., power, frequency, and waveform) radiofrequency transmissions. The technology is applied by inserting a flexible coaxial transmission line and applicator (antenna) system into either a multiple of vertical or horizontal boreholes or a combination within or adjacent to the volume to be treated. Radiofrequency generators supply energy through coaxial lines connected to a multiple of electromagnetically coupled borehole antennas. The subsurface material between the antennas rises in temperature as it absorbs radiofrequency energy radiating from the antennas. In one embodiment of the present invention, the treatment system includes a network of 100-foot to 3000 foot deep boreholes, radiofrequency generators and collocated array of radar and heating antennas and a separate means to collect and remove the solids, liquids, or gases.

Radiofrequency energy prefers the dielectric properties of water over those of soil and bedrock and therefore initially targets water. As a result, the radiofrequency heating selectively heats pore water and free water in bedrock fractures. The bedrock itself is not initially targeted by the radiofrequency energy, but undergoes secondary heating via conduction and convection from the heated groundwater. By pulsing the radiofrequency energy, this secondary heating process is minimized.

The collocated radar scans the radiofrequency heated material and may be deployed in two different configurations: reflection mode where the transmitter and the receiver are positioned in the same borehole or monostatic mode, bistatic mode where the transmitter and the receiver are separated in neighboring boreholes or multistatic mode in which the heated material is scanned by both the bistatic mode and monostatic mode radars.

In a collocated monopulse radar system, for example, more than one antenna beam may be utilized. The beams are offset and the signals received there from are combined to simultaneously provide sum and difference signals which themselves are combined in order to obtain information necessary to determine angular tracking. Conventional two coordinate (azimuth and elevation) monopulse systems employ at least two RF channels to obtain tracking error signals from the RF characteristics of the system. One such system is disclosed in U.S. Pat. No. 3,346,861, G. G. Chadwick, et al. entitled "Sum-Difference Feed Network", dated Oct. 10, 1967. The sum and difference antenna concept is additionally taught for example in U.S. Pat. No. 3,594,811, R. L. Pierrot, entitled "Sum and Difference Antenna", Jul. 20, 1971.

Operation of the radiofrequency heating system using collocated radar provides energy efficient treatment and maximizes recovery of the gas and liquid deposits. Radiofrequency power creates zones of fracture, a significant technical and economic advantage over existing methods of gas recovery such as the method of hydraulic fracturing.

The collocated radar component detects naturally occurring rock fracture zones or changes in microporosity and may detect concentrations and movements of the materials such as oil flow for energy efficient fluid and gas recovery. The radar assistants in defining the drainage area of the heated oil to insure that oil recovery boreholes are properly located to maximize the product recovery by conventional means. The radar guidance and detection capability provides real time monitoring of the subsurface material movements through electromagnetic energy absorption and reflections.

The present embodiment may also apply radiofrequency energy to heat fractured bedrock contaminated with pollutants or other chemicals. Radiofrequency energy has advantages over the other current potential methods for remediating fractured bedrock sites such as resistive heating or steam injection which are limited by electrical conductivity and permeability, respectively. Conventional electricity requires water for conductivity which vaporizes at 100 C.

In a general aspect, a method includes inserting an antenna system, including a radio frequency heating antenna and a radar antenna array into a subterranean borehole, guiding the antenna system to a desired location in the subterranean borehole using the radar antenna array, and heating an area around the desired location in the subterranean borehole using the radio frequency heating antenna.

Aspects may include one or more of the following features.

The steps of guiding the antenna system and heating the area around the desired location may be performed simultaneously. Guiding the antenna system to the desired location may include identifying the desired location including identifying fractures in inorganic material in an area surrounding a portion of the subterranean borehole. Guiding the antenna system to the desired location may include identifying the desired location including determining a microporosity of inorganic material in an area surrounding a portion of the subterranean borehole.

Guiding the antenna to the desired location may include identifying a current direction of flow of heated organic material, determining a desired direction of flow of the heated organic material, and moving the antenna system based on a difference between the current direction of flow and the desired direction of flow. The desired location may include an organic material recovery well. The desired location may include a well including an inorganic material treatment area. Heating the area around the desired location may include causing the radio frequency heating antenna to emit radio frequency radiation. A power level of the radio frequency radiation may be in a range of 5 kilowatts to 1 megawatt.

Guiding the antenna to the desired location may include identifying a current direction of flow of heated organic material, determining a desired direction of flow of the heated organic material, and adjusting a performance of the antenna system based on a difference between the current direction of flow and the desired direction of flow.

Causing the radio frequency heating antenna to emit radio frequency radiation may include causing the radio frequency heating antenna to emit pulses of radio frequency radiation. A duty cycle of the pulses may be in a range of 0.0001 to 0.1. Causing the radio frequency heating antenna to emit radio frequency radiation may include causing the radio frequency heating antenna to continuously emit radio frequency radiation.

In another general aspect, a subterranean borehole antenna system includes a radar antenna array including a first radar antenna arranged coaxially with a second radar antenna, and a radio frequency heating antenna arranged coaxially with the first radar antenna and the second radar antenna and separating the first radar antenna and the second radar antenna.

Aspects may include one or more of the following features.

The antenna system may include one or more radio frequency generators coupled to the radar antenna array using a coaxial transmission line. The one of the one or more radio frequency generators may be configured to cause the radio frequency antenna to emit pulses of radio frequency radiation with a power level in a range of 5 kilowatts to 1 megawatt. One of the one or more radio frequency generators may be configured to cause the radio frequency heating antenna to emit pulses of radio frequency radiation. A duty cycle of the pulses may be in a range of 0.0001 to 0.1. One of the one or more radio frequency generators may be configured to cause the radio frequency heating antenna to emit continuous radio frequency radiation. The radio frequency heating antenna may include a helical antenna.

The radio and radar antenna arrays may be sized and shaped to be physically compatible with a borehole structure and suitable for efficiently radiating high power electromagnetic energy through it into the formation. The borehole may be structurally lined with electromagnetically transparent material such as fiberglass. Different dielectric and physical properties of the fiberglass liner may be used to optimize the radiation efficiency of both the radio and radar antenna arrays. The spacing between the radar antennas may be based on the size and distance of the heated volume or radar target from the borehole to achieve an adequate return signal to noise ratio and target resolution for the radar receiving antenna.

The radio antenna may have a length configured for a specific frequency of operation to achieve the required depth of penetration of the radiofrequency energy. The radio antenna may be sized in diameter in the borehole to avoid high voltage breakdown and arcing between the antenna metal surface and wall of borehole. The radar antennas may be located near the distal and proximal ends of the radio antenna to achieve proper focusing of the radar energy. The frequency and spacing's between the radar and radio antennas may be chosen to insure high image data resolution with minimum propagation losses from borehole to target and minimize electromagnetic interference among antennas.

The length of the radar antennas may be chosen to give the optimum aperture size in borehole for efficiency and beam directivity and antenna power gain. The radio antenna may be provided with telescopic extensions for impedance tuning and achieving different depths of energy penetration based on a combination of frequency and antenna length. The radar antennas may be built into telescopic extensions of the radio antenna and thereby automatically provide the necessary spacing between the radar antennas as dictated by the depth on energy penetration which increases with the radio antenna length. The borehole antenna array of both radio and radar antennas may be extended from a single borehole application to a multiple borehole system such as in a square 4 spot pattern of antenna boreholes with oil recovery wells located within or without the heating pattern. The radio antennas may be phase current modulated to create many possible heating patterns. The size of the multiple borehole antenna array is dictated by the required oil drainage area. Spacing between any pair of bore holes can be 50 meters apart at 1 MHz in oil shale for oil and gas recovery at 350 degrees C., the required temperature for high quality oil (high API) from kerogen rich oil shale The production of steam from the connate water using the radio antenna in the formation expands the porosity and permeability of the formation. The depth of connate water dictates the required radio antenna power and frequency to produce a water vapor phase. Intragrain and grain boundary fractures already in existence are enhanced by the connate water steaming with associated enhanced oil and gas recovery. The connate water may be heated by the radiofrequency energy of sufficient electric field amplitude and frequency to cause a water vapor plasma or burning water in the pore volumes and existing microcrack structures. The high temperatures produced by the burning water, in excess of 400 degrees C. will expand the rock pore space and cause new fracture pathways for enhanced fluid permeabilities.

The radar system may be used to monitor development of new fracture zones thereby determining the extent and distribution of the new permeability pathways. The steam induced micro fracturing process can be controlled by radar measurements of the change in the formation index of refraction resulting from the fracturing. The mobility of the oil mass movement toward a production well or away from a production well can be constantly monitored by the radar antenna system. Changes in radio power, radio antenna position and frequency may be necessary to insure effective oil recovery from existing oil recovery wells. The borehole antenna system may be applicable to the efficient recovery of contaminants in environmental remediation. Chemical spills such as TCE or oil spills in soils can be thermally treated and efficiently recovered by radar means.

The antenna system may be employed from a floating platform to recover oil spill in water or on the surface. The borehole arrangements may be of any nature such as either vertical and/or horizontal wells as practiced in the oil and gas recovery industries. The borehole may be preheated to the boiling point of connate water for removal as steam using alternating current (AC) electrodes before insertion of the antenna system. The result is a dry zone (dissication) around the antenna borehole to improve the radiation efficiencies of both the radar antennas and radio antenna by having a low conductivity region adjacent to borehole. The co-located borehole radar system may be bistatic. The collocated borehole radar system may be monostatic. The collocated radar system may be multistatic.

A radiofrequency heating system with radar control or SMART (Subsurface multiple antenna radiation technology) offers a new means of actively controlling RFH technology to understand the impact of fluid dynamics for optimum oil and gas recovery. The ability to interrogate and image the thermal effects on the fluid dynamics during the heating process with zonal production control and monitoring will provide the most optimum means of achieving high oil production using RFH technology. Data transmission of such information to the surface radiofrequency power control system allows for interactive control of the RFH process. With such information in real time, automatic adjustment in antenna borehole position, heating pattern adjustments, temperature adjustments, and heating rate adjustments will insure that the desired hydrocarbon masses are recovered.

One example of the impact of fluid dynamics is in a RAGD (radiofrequency assisted gravity drainage used in Canada) horizontal well application where radio energy has replaced the use of steam in SAGD (steam assisted gravity drainage). A typical heavy oil environment is where the oil is located in a sand layer that is embedded by layers of shale. In the upper region of the reservoir is the well containing the SMART antenna. The radiofrequency heating reduces the high viscosity of the heavy oil and makes the oil drain toward a lower and nearby horizontal production well. The SMART antenna may operate in a bi-static radar mode during the heat application. In one case of the SMART borehole antenna, transversely polarized radiators (helix antenna) may be employed producing a field in which the electric field vector lies in planes normal to the axis of the radiofrequency antenna.

In a general aspect, a collocated radar and electromagnetic heating system is located in a borehole for the processing and recovery of organic or inorganic materials in the form of liquid, vapor, or solid.

Aspects may include one or more of the following features.

The system may include spaced vertical or horizontal boreholes in a subterranean site and/or a combination of vertical and horizontal boreholes. The system may include a radiofrequency high power antenna positioned within the borehole, a super gain radar collocated with high power heating antenna, a cable attached to the radiofrequency antenna to supply radiofrequency to the antenna, and a cable attached to the borehole radar for data collection and power transmission. The system may include a radiofrequency generator attached to the cable to generate radiofrequency to be supplied to the radiofrequency antenna. The system may include a surface data collection system for processing borehole radar data.

The system may include a borehole antenna array. The borehole antenna system may operate in the super gain mode as either a guidance radar or surveillance radar. The borehole heating system may include a solenoid antenna, a helix antenna, or any cylindrical antenna structure compatible with a collocated radar antenna.

In another general aspect, a collocated borehole array selectively heats organic or inorganic material through control of a duty cycle of radiated electromagnetic power. In another general aspect, a collocated borehole array selects a frequency and a radiated power intensity based on an effective breaking or vibration of chemical bonds for gas desorption. In another general aspect, a collocated borehole array fractures rock through enhanced vapor pressure of pore water or changes in electrical conductivity to create a channel of plasma for rock fracturing. In another general aspect, a collocated radar positions a heating antenna to target a precise location of desired organic or inorganic materials. In another general aspect, a collocated radar provides information to a surface operator on a status of the recovery and processing process occurring at a chosen depth. In another general aspect, a collocated radar provides information on an optimum location of a heating antenna to insure optimum recovery and processing conditions during heat application.

Aspects may include one or more of the following features.

Systems may include a soil vapor extraction well in the contaminated bedrock site, a soil vapor collector at the mouth of the soil vapor extraction well.

In another general aspect, a method for remediating contaminated fractured bedrock sites includes positioning a radiofrequency antenna in a borehole in a contaminated bedrock site, generating radiofrequency energy, and applying the radiofrequency energy to the contaminated bedrock site with the antenna to heat water and contaminants in the contaminated bedrock site to the thermal degradation point of the contaminants.

Other features and advantages of the invention are apparent from the following description, and from the claims.

DETAILED DESCRIPTION

Figure 1:
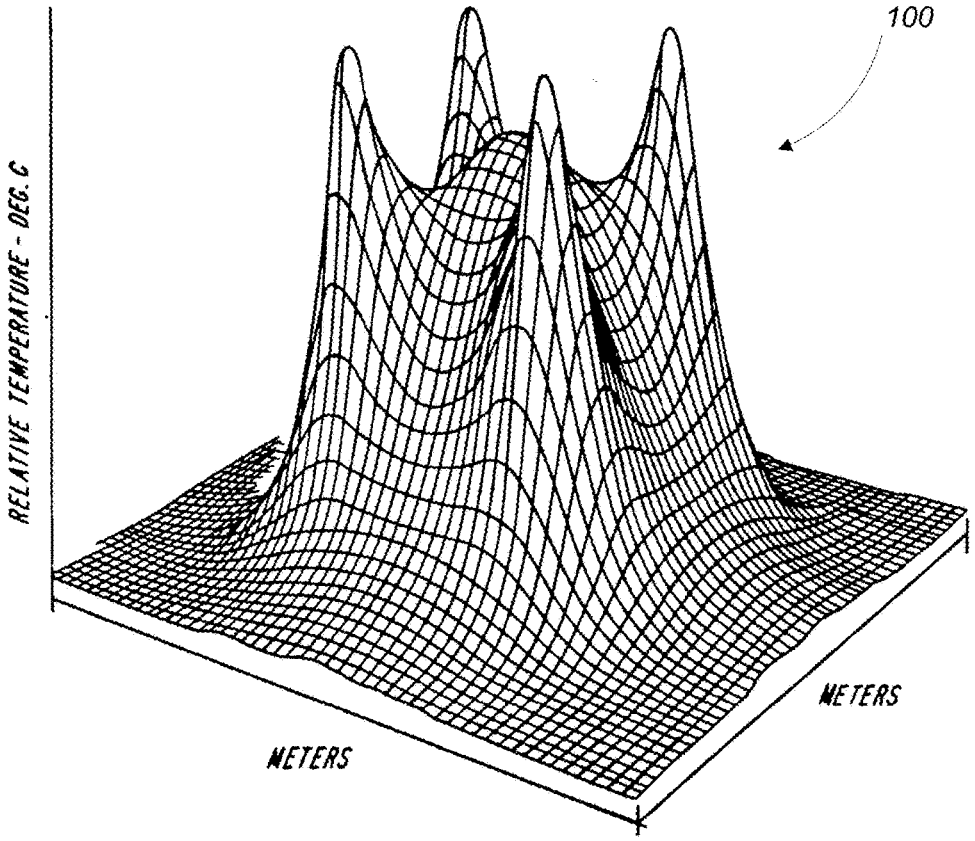
FIG. 1 is a graph of a heating pattern for a for a four antenna heating system.

Aspects described herein relate to systems for sub-surface, the systems including high power radiofrequency heating antennas collocated with radar antennas. In general, the collocated antennas are inserted into boreholes which may be of the vertical or horizontal type as indicated in U.S. Pat. No. 7,891,421 by Kasevich. The collocated antennas may be positioned at various depths down to several thousand feet and at frequencies of operation that may range from hundreds of kilohertz 50 MHz. Power levels for the system may vary from 5 kilowatts to 1 megawatt for CW and if pulse power is used, the duty cycle may range from 0.0001 to 0.1 as an example. Referring to FIG. 1, one possible heating pattern 100 for a four heating antenna system in which the antenna boreholes with collocated radar are spaced ½ wavelength apart on square is illustrated. Such a pattern of heat is described in U.S. Pat. No. 5,199,488 by Kasevich. At one MHz in an oil shale material, the square is 50 meters by 50 meters. The maximum of heating takes place in the center of the square if all the high power currents of the heating antennas are in time phase. Other possible heating patterns the square areas are possible depending on the time phasing of the input currents.

Figure 2:
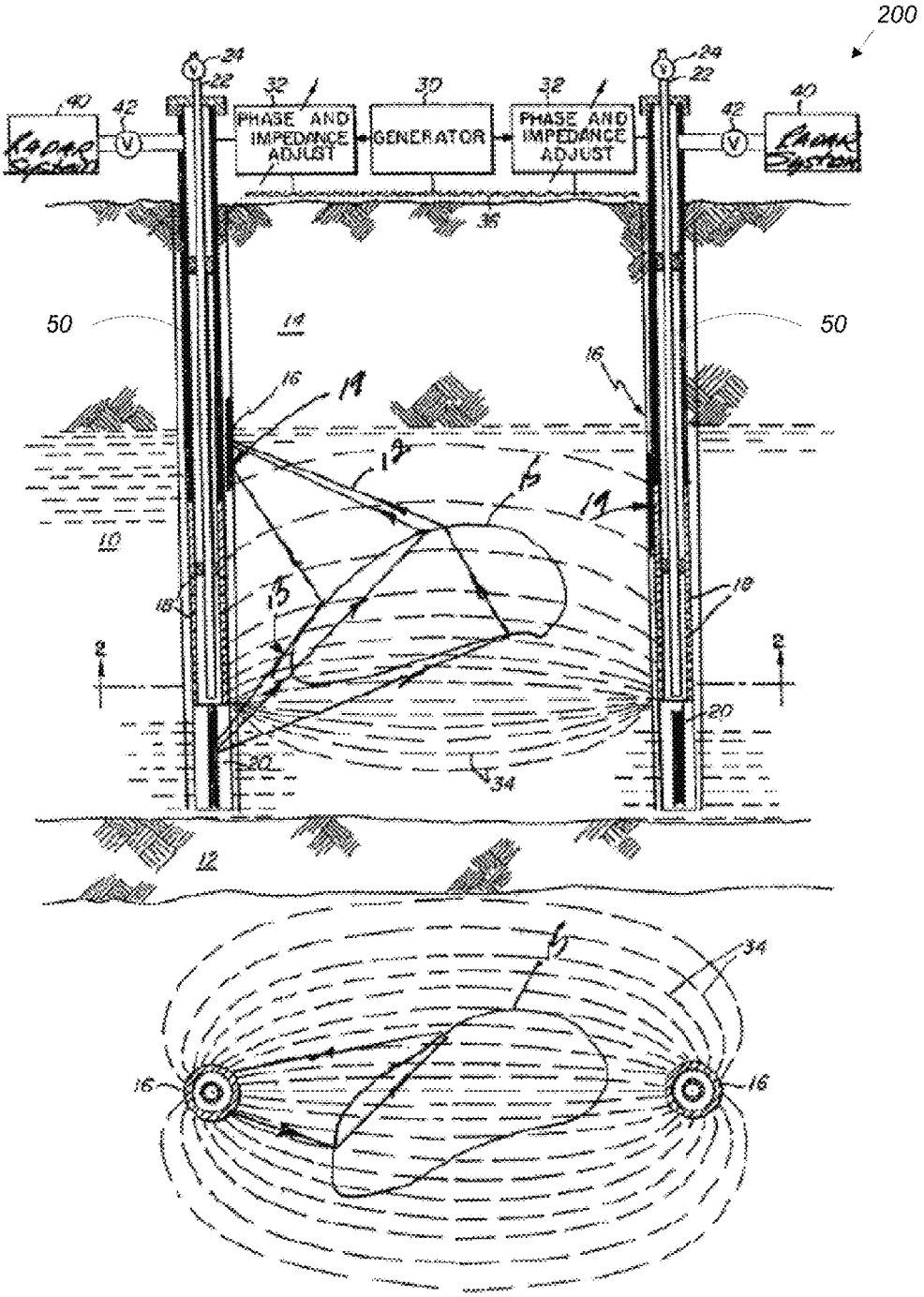
FIG. 2 is a collocated radar antenna and heating system.

Referring to FIG. 2, in some examples, a collocated radar antenna and heating system 200 includes two high power radiofrequency (RF) heating antennas that are collocated with bistatic radar antennas. The collocated bistatic radar antennas are attached to the distal end of each radiofrequency heating antenna with a maximum of electromagnetic isolation from the high power radiofrequency heating antenna and possible operation when the high power radiofrequency heating antenna is temporarily shut off.

Two boreholes 16 are drilled in a hydrocarbon bearing formation such as targeted region 10. Electrical currents supplied by a generator 30 are 180 degrees apart in time phasing for maximizing the heating effects when the spacing between the antennas is not large. The depth of the boreholes 16 is dictated by the characteristics of the formation of targeted region 10 and specifically a mass of oil 15 in motion. The boreholes 16 should be deep enough that the collocated antenna system (SMART) can be placed in proximity to the oil mass 15. The radio frequency heating antenna 18 is a high power, coaxial structure attached to an outer conductor 50. In some examples, the outer conductor 50 also serves as a borehole casing. In general, the bistatic radar antennas 20 do not require electrical contact with the formation of targeted region 10 and are electrically isolated from the heating antenna 18 but are physically attached using insulative material such as ceramics. The dielectric heating produced by the radiofrequency heating antennas 18 extends vertically and horizontally away from the radio frequency heating antennas 18 as indicated by the dashed lines 34. The required spacing between the boreholes 16 depends on the operating frequency of the system, length of the radio frequency heating antennas 18, and the electrical conductivity and dielectric constant of the target mass 15 and surrounding the formation of targeted region 10.

A variety of radiofrequency antennas that are known in the art are suitable for this application. For example, the antennas described in U.S. Patent Application 60/645,154, U.S. Pat. No. 5,065,819, or J. Bridges, et al., "RF Heating of Utah Tar Sands," Final Report, IIT Research Institute, may be utilized.

In some examples, the radar antennas 20 are dipole or helix or many different combinations of known radar antenna types inside a bare borehole which may or may not be cased with electromagnetically transparent material such as fiberglass. The collocated radar antennas 20 operate in a bistatic mode transmit and receive signals based on the intercepted volume of oil mass 15.

The radar antennas 20 include the necessary electronics for transmitting or receiving low power signals from the surface or adjacent radar antenna. In some examples, the radar antennas extend beyond the distal end of the heating antenna to provide different vertical radiation patterns to intercept and define the extent of the oil mass. The radar antenna may undergo length change by means of telescopic arms as in a dipole configuration to change beamwidth.

The radiofrequency heating antennas 18 are connected to a radiofrequency generator 30 by a coaxial cable 22. The radiofrequency power that is generated by radiofrequency generator 30 passes through phase and impedance adjustment networks 32 and is transmitted to the radiofrequency heating antennas 18 by coaxial cables 22. The radiofrequency heating antennas 18 then radiate radiofrequency energy to targeted volume 15.

In operation, a user of an embodiment of the present invention would position radiofrequency antennas in boreholes opposite a zone where oil recovery or fracturing for gas recovery is desired. The user would connect the antennas to a radiofrequency generator via coaxial cable. The user would then apply radiofrequency energy using the radiofrequency generator to the antennas, thereby applying the radiofrequency energy target material High power radiofrequency transmitters of 50,000 watts or greater may be used with frequencies in the 1 to 30 MHz range. The radars would be controlled from the surface by signal cabling located inside the heating antenna center conductor connected to radar data processing units 40.

In some embodiments, the system 200 is configured to operate in a monostatic mode of collocated radar antennas for a borehole. For example, a receive antenna 19 is located inside an electromagnetically transparent, small diameter tubing 50 that is compatible with the given borehole size. This tubing 50 is parallel to a high power coaxial line 22. The separation of radar antennas 20 by proper positioning of the receiving antenna 19 allows for many possible azimuth and elevation patterns of the collocated radar antennas 20 well as beam width and gain control of the borehole radar system.

Figure 3:
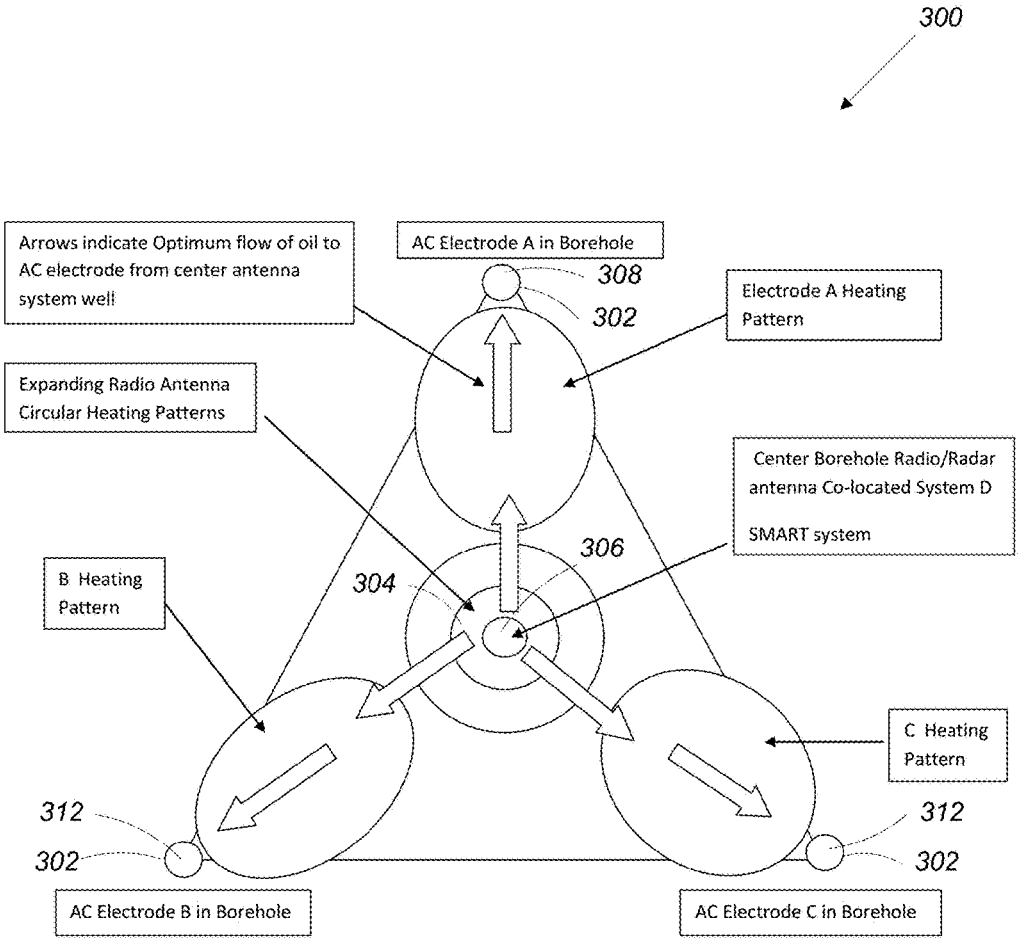
FIG. 3 is a collocated radar antenna and heating system including AC electrodes.

Referring to FIG. 3, in some examples, the SMART system 300 also employs alternating current (AC) electrodes 302 to compliment the heating provided by the radiofrequency (RF) heating antenna. In FIG. 3, the system in borehole D 304 is at the geometric center of a triangular grid of three AC electrodes 302, A, B, and C For example, the three AC electrodes 302 are arranged so as to form an equilateral triangle with sides equal to 400 feet. This provides well spacing's between the antennas (radio and radar) in well D 304 and each electrode borehole of approximately 200 feet. The total treatment area is approximately 1.5 acres. Radio power provided by the center well D antenna 306 radiates heat energy toward each of the electrode wells which creates: 1.) a miscible bank of hot fluids propagating toward the AC electrode wells which have fluid recovery capability and 2.) enhanced reservoir pressure directed from well D 304 to wells A 308, B 310, and C 312 (U.S. Pat. No. 6,189,611 by Kasevich.) for improved oil recovery. Each AC electrode heating pattern creates a high permeability zone toward the center well which aids in oil recovery by wells A 308, B 310, and C 312. Some recovery will occur also at well D 304. The electrode heating removes connate water and oil around them which the radiofrequency (RF) antenna fields cannot easily reach. The two different heating patterns (RF and AC) acting synergistically provide exceptionally large oil recovery zones therefore reducing drilling requirements for a given volume of oil recovery.

The AC heating in combination with the dynamic RF heating creates a miscible bank of hot oil and gas movement toward the AC wells simultaneously enhances overall permeability and reservoir pressure drive for increased oil recovery at higher overall energy efficiency. The electrode wells may contain radar antennas for surveillance and imagery as described in the SMART system.

Figure 4:
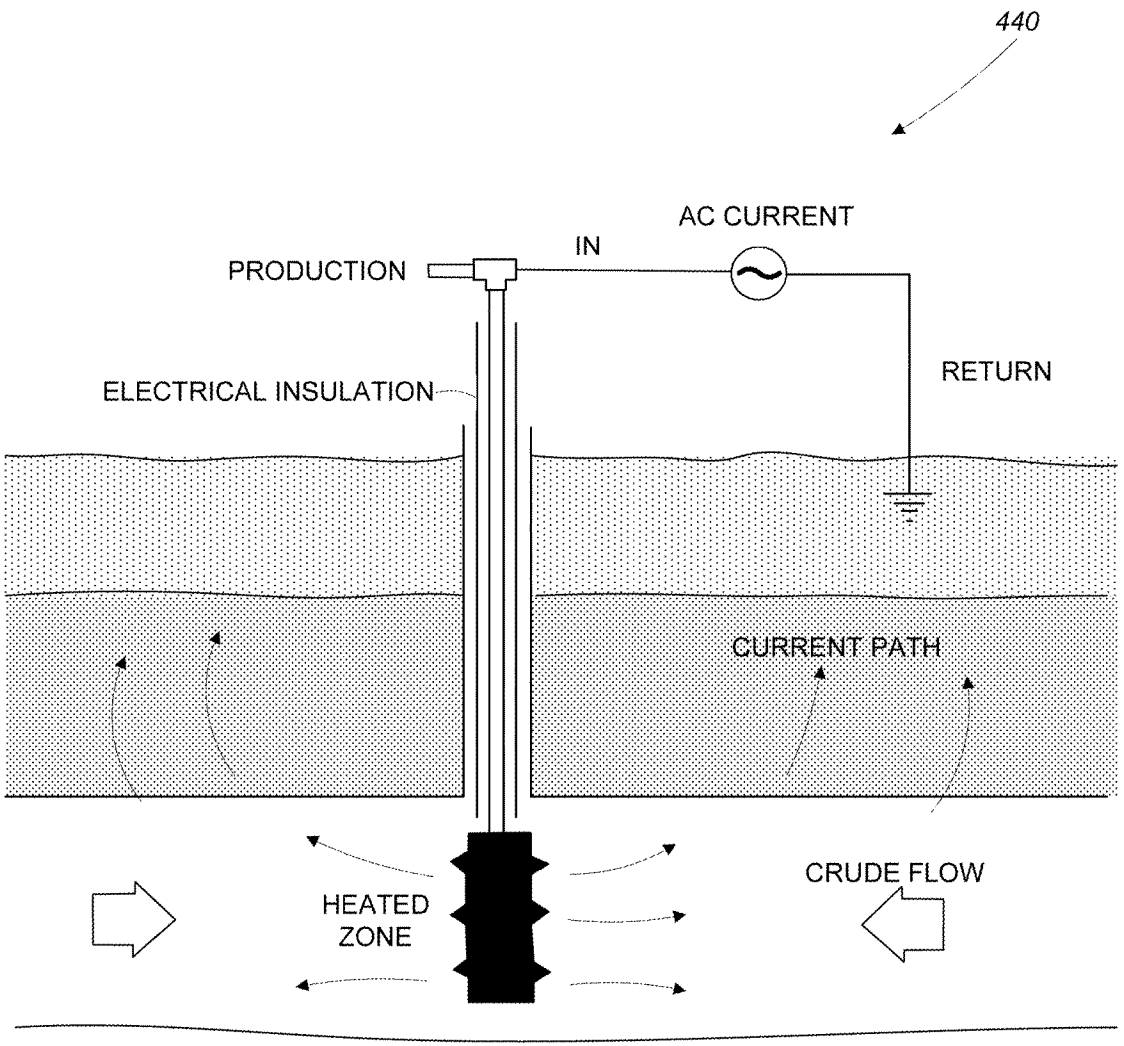
FIG. 4 is a single electrical phase AC electrode heating system.

Referring to FIG. 4, an example of a single electrical phase AC electrode system 400 may be provided with contact points along its surface (Hugh Gill, Journal of Microwave Power, 18(1) 1983), or the air space in borehole where the electrode is located may be filled with electrically conductive material such as graphite or brine.

The contact points of the AC electrode may have contact points on one side only to provide an asymmetric heating pattern as indicated in FIG. 4. The arrangements of grounding of electrical contacts on the electrode surface control the directionality and shape of its heating pattern.

Figure 5:
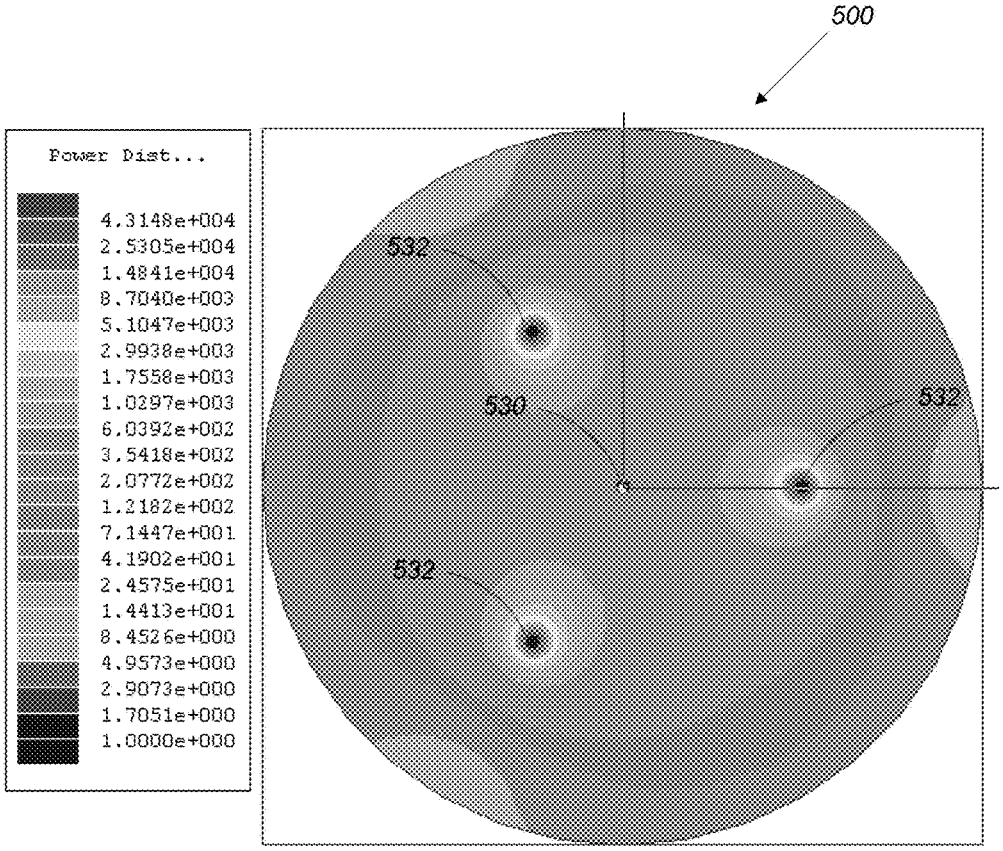
FIG. 5 is a graph of a heating pattern generated by a specific arrangement of AC electrodes in a borehole.

The three AC electrodes may also be excited using a three phase electric utility system as described by Kasevich in U.S. Pat. No. 6,413,399. The flow of heat would be both circumferential and radial within the triangular grid system when three phase power is employed for the three electrodes in FIG. 4, one electrode per phase. The use of a three phase AC power system would provide more uniform heating and spatial variability of the subsurface heating pattern through rotating electric fields Referring to FIG. 5, one possible application for oil recovery would be employing three electrodes 532 positioned on a 400 foot diameter circle, with equal distance to each other as indicated in FIG. 5 (120 angular degrees apart). A neutral electrode 530 is placed in the center of the circle. When three-phase power is applied to the electrodes 532, the current will flow between the three-phase electrodes, as well as to the neutral electrode, creating a rotating soil electric field similar to a three phase synchronous or induction motor rotating magnetic field for production of torque. The resulting heating pattern 500 is indicated in FIG. 5.

The borehole heating electrodes may be made of steel, copper, or aluminum.

While a number of embodiments of the SMART system are described above, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

What is claimed is:

1. A method comprising:

configuring an antenna system comprising a radio frequency heating antenna attached to a coaxial cable and a first radar antenna array attached to the coaxial cable at a distal end of the radio frequency heating antenna, wherein the radio frequency heating antenna is electrically coupled to a radio frequency generator via the coaxial cable:

inserting the antenna system comprising the radio frequency heating antenna and the first radar antenna array into a subterranean borehole;

guiding the antenna system to a desired location in the subterranean borehole using the first radar antenna array; and heating, by the radio frequency heating antenna, an area around the desired location in the subterranean borehole using the radio frequency heating antenna to form a heated organic material;

imaging a thermal effect of heating on the heated organic material; and adjusting at least one of a heating pattern, a heating temperature, and a heating rate of the radio frequency heating antenna by changing at least one of an output power and a frequency of the radio frequency generator.

2. The method of claim 1 wherein the steps of guiding the antenna system and heating the area around the desired location are performed simultaneously.

3. The method of claim 1 wherein guiding the antenna system to the desired location includes identifying the desired location including identifying fractures in inorganic material in an area surrounding a portion of the subterranean borehole.

4. The method of claim 1 wherein guiding the antenna system to the desired location includes identifying the desired location including determining a microporosity of inorganic material in an area surrounding a portion of the subterranean borehole.

5. The method of claim 1 wherein guiding the antenna to the desired location includes:

identifying a current direction of flow of the heated organic material;

determining a desired direction of flow of the heated organic material; and moving the antenna system based on a difference between the current direction of flow and the desired direction of flow.

6. The method of claim 5 wherein the desired location includes an organic material recovery well.

7. The method of claim 5 wherein the desired location includes a well including an inorganic material treatment area.

8. The method of claim 1 wherein guiding the antenna to the desired location includes:

identifying a current direction of flow of the heated organic material; determining a desired direction of flow of the heated organic material; and moving the antenna system based on a difference between the current direction of flow and the desired direction of flow.

9. The method of claim 1 wherein heating the area around the desired location includes causing the radio frequency heating antenna to emit radio frequency radiation.

10. The method of claim 9 wherein a power level of the radio frequency radiation is in a range of 5 kilowatts to 1 megawatt.

11. The method of claim 9 wherein causing the radio frequency heating antenna to emit radio frequency radiation includes causing the radio frequency heating antenna to emit pulses of radio frequency radiation.

12. The method of claim 11 wherein a duty cycle of the pulses is in a range of 0.0001 to 0.1.

13. The method of claim 9 wherein causing the radio frequency heating antenna to emit radio frequency radiation includes causing the radio frequency heating antenna to continuously emit radio frequency radiation.

14. The method of claim 1, wherein the antenna system has a longitudinal axis and the radio frequency heating antenna is spaced from the first radar antenna along the longitudinal axis.

15. The method of claim 1 further comprising using the first radar antenna to image thermal effects at the desired location during heating of the area around the desired location.

16. The method of claim 1, wherein configuring the antenna system further comprises:

coaxially arranging a second radar antenna with the radio frequency heating antenna such that the radio frequency heating antenna separates the first radar antenna from the second radar antenna attached to the distal end of the radio frequency heating antenna.

17. The method of claim 1, wherein the configuring the antenna system further comprises:

arranging a first alternating current (AC) electrode in a first electrode borehole and a second AC electrode in a second electrode borehole around the radio frequency heating antenna and the first radar antenna attached to the distal end of the radio frequency heating antenna, configured to compliment heating provided by the radio frequency heating antenna, wherein the first AC electrode and the second AC electrode compliment heating provided by the radio frequency heating antenna.

18. The method of claim 17, further comprising a third AC electrode in a third electrode borehole, wherein the first electrode borehole, the second electrode borehole, and the third electrode borehole form an equilateral triangle around the radio frequency heating antenna.

* * * * *